US011834869B2

(12) United States Patent
Romero

(10) Patent No.: US 11,834,869 B2
(45) Date of Patent: Dec. 5, 2023

(54) DUAL FUNCTION HANDLE SET

(71) Applicant: Spectrum Brands, Inc., Middleton, WI (US)

(72) Inventor: Oscar Romero, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 2 days.

(21) Appl. No.: 17/371,461

(22) Filed: Jul. 9, 2021

(65) Prior Publication Data

US 2022/0010595 A1 Jan. 13, 2022

Related U.S. Application Data

(60) Provisional application No. 63/050,579, filed on Jul. 10, 2020.

(51) Int. Cl.

| | |
|---|---|
| ***E05B 65/00*** | (2006.01) |
| ***E05B 13/00*** | (2006.01) |
| ***E05B 1/00*** | (2006.01) |
| ***E05B 15/00*** | (2006.01) |

(52) U.S. Cl.

CPC ..... *E05B 65/0035* (2013.01); *E05B 1/003* (2013.01); *E05B 1/0038* (2013.01); *E05B 13/004* (2013.01); *E05B 15/0033* (2013.01)

(58) Field of Classification Search

CPC ..... E05B 65/00; E05B 65/0035; E05B 1/00; E05B 1/003; E05B 1/0038; E05B 3/00; E05B 5/00; E05B 13/00; E05B 13/10; E05B 13/103; E05B 13/105; E05B 13/002; E05B 13/004; E05B 47/0657; E05B 15/00; E05B 15/0033

USPC ..... 70/91

See application file for complete search history.

(56) References Cited

U.S. PATENT DOCUMENTS

| | | | |
|---|---|---|---|
| 2,263,477 | A | 11/1941 | Voight |
| 2,386,868 | A | 10/1945 | Karczewski |
| 2,400,403 | A | 5/1946 | Falk |
| 2,420,114 | A | 5/1947 | Vander Henst |

(Continued)

FOREIGN PATENT DOCUMENTS

| | | | |
|---|---|---|---|
| EP | 1717389 | A1 | 11/2006 |
| WO | 2017165649 | A1 | 9/2017 |

OTHER PUBLICATIONS

International Search Report and Written Opinion for PCT/US2021-041154, dated Oct. 21, 2021.

*Primary Examiner* — Nathan Cumar

(74) *Attorney, Agent, or Firm* — Merchant & Gould P.C.

(57) ABSTRACT

A handle set includes a main body that has a handle and a faceplate positioned around the handle, the faceplate having a toggle aperture. The handle set includes a locking mechanism that includes a locking piece that has a locking notch. The locking mechanism includes a toggle positioned within a toggle housing, the toggle being movable relative to the toggle housing. The toggle includes a toggle tail configured to be received into the locking notch. The toggle includes a toggle head removably attached to the toggle tail, the toggle head being at least one of a privacy attachment button and a passage attachment button. At least a portion of the privacy attachment button extends from the toggle aperture and beyond the faceplate. The passage attachment button interfaces with the toggle housing to prevent relative movement between the passage attachment button and the toggle housing.

19 Claims, 13 Drawing Sheets

(56) References Cited

U.S. PATENT DOCUMENTS

| | | | | |
|---|---|---|---|---|
| 2,499,948 | A | 3/1950 | Basil | |
| 2,593,573 | A | 4/1952 | Kulbersh | |
| 2,605,124 | A | 7/1952 | Hillgren | |
| 2,653,047 | A | 9/1953 | Sultan | |
| 2,723,874 | A | 11/1955 | Hillgren | |
| 3,212,806 | A | 10/1965 | Russell et al. | |
| 4,142,748 | A | 3/1979 | Hook | |
| 4,143,529 | A | 3/1979 | Brummett et al. | |
| 4,866,965 | A | 9/1989 | Urdal | |
| 5,067,758 | A | 11/1991 | Fann et al. | |
| 5,083,823 | A | 1/1992 | Fann et al. | |
| 5,286,074 | A | 2/1994 | Lin | |
| 5,364,139 | A | 11/1994 | Bergen et al. | |
| 5,505,508 | A | 4/1996 | Kuo | |
| 5,562,317 | A | 10/1996 | Kuo et al. | |
| 5,826,924 | A | 10/1998 | Huang | |
| 5,941,108 | A | 8/1999 | Shen | |
| 6,502,872 | B1 | 1/2003 | Molzer | |
| 6,553,799 | B2 | 4/2003 | Bates et al. | |
| 6,568,231 | B1 * | 5/2003 | Huang | E05B 13/004 70/489 |
| 6,644,077 | B1 | 11/2003 | Huang | |
| 7,387,005 | B2 | 6/2008 | Huang et al. | |
| 7,900,978 | B2 | 3/2011 | Zimmer | |
| 8,047,586 | B2 | 11/2011 | Pilotelli | |
| 2005/0046203 | A1 | 3/2005 | Huang | |
| 2005/0225097 | A1 | 10/2005 | Geringer et al. | |
| 2007/0068209 | A1 * | 3/2007 | Huang | E05B 65/0035 70/467 |
| 2017/0122002 | A1 * | 5/2017 | Morse | E05B 13/004 |
| 2017/0218659 | A1 * | 8/2017 | Chong | E05C 1/163 |
| 2017/0275914 | A1 * | 9/2017 | Murphy | E05B 55/005 |

* cited by examiner

DUAL FUNCTION HANDLE SET

CROSS-REFERENCE TO RELATED APPLICATIONS

The present application claims priority from U.S. Provisional Application No. 63/050,579, filed on Jul. 10, 2020, the disclosure of which is hereby incorporated by reference in its entirety.

BACKGROUND

Residential handle sets are traditionally built according to their function. Among the most common functions for a residential lock are an entry function, a privacy function, and a passage function. An entry function refers to a handle set that is installed at a door where a user desires to use a key to lock or unlock the door from the outside of the door. A privacy function is used when it is desired to lock a door from the inside, for example such as for use on a bathroom or a bedroom door. Privacy function locks traditionally do not have a cylinder lock or a key. A passage function is used when it is not needed to lock the door, for example, such as a bedroom closet.

The disadvantage to having different handle sets that have different functions is that all three types of handle sets need to be kept in inventory. Carrying each type of handle set requires additional cost to be invested in maintaining inventories, and also requires more shelf space at a retail location. At the same time, a user would not typically install a handle set adapted to an entry function for use in applications requiring a passage or privacy function because of the relatively higher cost of such a handle set. Accordingly, if a user desires to change the function of the handle set, the user must typically purchase a separate handle set to achieve a different function. Therefore, improvements are desired.

SUMMARY

The present disclosure relates generally to a handle set for a door, where the handle set can either be a privacy handle set including a locking feature or a passage handle set.

In one example of the present disclosure, a handle set is disclosed. The handle set includes a main body that has a handle and a faceplate positioned around the handle, the faceplate having a toggle aperture. The handle set includes a locking mechanism that includes a locking piece that has a locking notch. The locking mechanism includes a toggle positioned within a toggle housing attached to the main body. The toggle is movable relative to the toggle housing. The toggle includes a toggle tail configured to be received into the locking notch. The toggle further includes a toggle head removably attached to the toggle tail. The toggle head is at least one of a privacy attachment button and a passage attachment button. At least a portion of the privacy attachment button extends from the toggle aperture and beyond the faceplate. Push and pull loads applied to the privacy attachment button result in translation of the toggle with respect to the toggle housing. The passage attachment button interfaces with the toggle housing to prevent relative movement between the passage attachment button and the toggle housing.

In another example of the present disclosure, a handle set is disclosed. The handle set includes an exterior portion having an exterior handle and an interior portion having an interior handle. The interior portion has an interior faceplate positioned around the interior handle and the faceplate has a toggle aperture. The handle set includes a spindle extending between the exterior and interior portions to translate a door latch. The exterior and interior portions each comprise exterior and interior assembly portions that are configured to operatively connect the spindle to the exterior and interior handles, respectively. The handle set further includes a locking mechanism that includes a locking piece having a locking notch operatively connected to at least one of the exterior or interior portions. The locking mechanism includes a toggle positioned within a toggle housing connected to at least one of the exterior or interior portions. The toggle is movable relative to the toggle housing. The toggle includes a toggle tail that is configured to be received into the locking notch. The toggle further includes a toggle head removably attached to the toggle tail. The toggle head is at least one of a privacy attachment button and a passage attachment button. At least a portion of the privacy attachment button extends from the toggle aperture and beyond the faceplate. Push and pull loads applied to the privacy attachment button result in translation of the toggle with respect to the toggle housing. The passage attachment button is positioned within the toggle aperture and flush with the faceplate. The passage attachment button interfaces with the passage housing to prevent relative movement between the passage attachment button and the toggle housing. The handle set further includes an unlocking piece connected to at least one of the exterior or interior portions and is configured to receive the spindle therein. When the interior handle is actuated, the spindle will rotate the unlocking piece to translate the toggle tail out of engagement with the locking piece.

In another example of the present disclosure, a method of selecting a privacy or passage handle set is disclosed. The method includes providing a handle set that includes a locking mechanism that includes a locking piece that has a locking notch. The locking mechanism includes a toggle positioned within a toggle housing, the toggle being movable relative to the toggle housing. The toggle includes a toggle tail configured to be received into the locking notch. The toggle includes a toggle head removably attached to the toggle tail, the toggle head being at least one of a privacy attachment button and a passage attachment button. Push and pull loads applied to the privacy attachment button result in translation of the toggle with respect to the toggle housing. The passage attachment button interfaces with the toggle housing to prevent relative movement between the passage attachment button and the toggle housing. The method includes attaching at least one of a privacy attachment button and a passage attachment button to the toggle tail. The method further includes activating a privacy mode when the privacy attachment button is attached to the toggle tail, wherein, when in the privacy mode, the handle set has a locked configuration and an unlocked configuration, wherein the locked configuration is when the toggle tail is positioned within the locking notch. The method further includes activating a passage mode when the passage attachment button is attached to the toggle tail. When in the privacy mode, the handle set only has an unlocked configuration.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
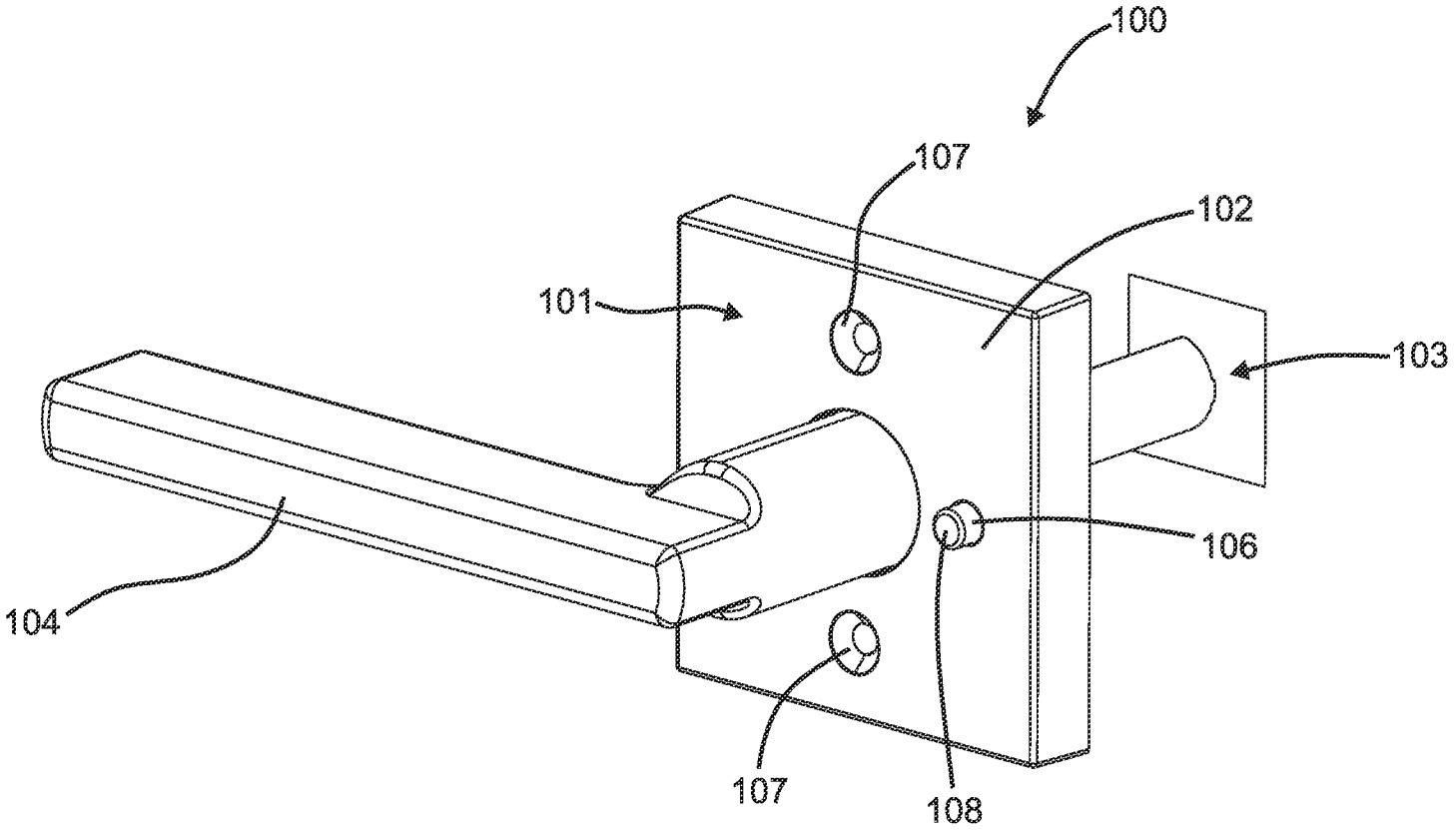
FIG. 1 illustrates a schematic perspective view of a handle set having a dual function with a privacy mode, according to one example of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 illustrates an example embodiment of a handle set 100 to be installed on a door. In the example shown, the handle set 100 has both a privacy function and a passage function. A privacy function allows the door to be locked by a user. A passage function does not allow the door to be locked. Examples of a handle set with a privacy function are described in U.S. Patent Publication Nos. 2017/0122002 and 2017/0218659, the disclosures of which are hereby incorporated by reference in their entirety.

FIG. 1 shows the handle set 100 with a privacy function. In some examples, the handle set 100 includes an interior portion 101 and an exterior portion 103. In some examples, the interior portion 101 is mounted to an interior side of a door and the exterior portion 103 is mounted to an exterior side of the door. The term "outside" is broadly used to mean an area outside the door and "inside" is broadly used to denote an area inside the door. With an interior door, the exterior portion 103 may be mounted inside a building, but outside a room, and the interior portion 101 may be mounted inside the room.

The handle set 100 includes a faceplate 102, an interior handle 104, an exterior handle 105, and a toggle aperture 106.

The faceplate 102 is generally decorative in nature, and in some examples, surrounds the interior handle 104. In some examples, the faceplate 102 can have a plurality of mounting holes 107 to accept fasteners.

The interior handle 104 can be a variety of different types such as, but not limited to, a knob or a lever. In some examples, the interior handle 104 is biased via a spring.

The toggle aperture 106 is at least partially defined by the faceplate 102. In the depicted example, a toggle head 108 is shown positioned at least partially within the toggle aperture 106 and extending therefrom beyond the faceplate 102.

Figure 2:
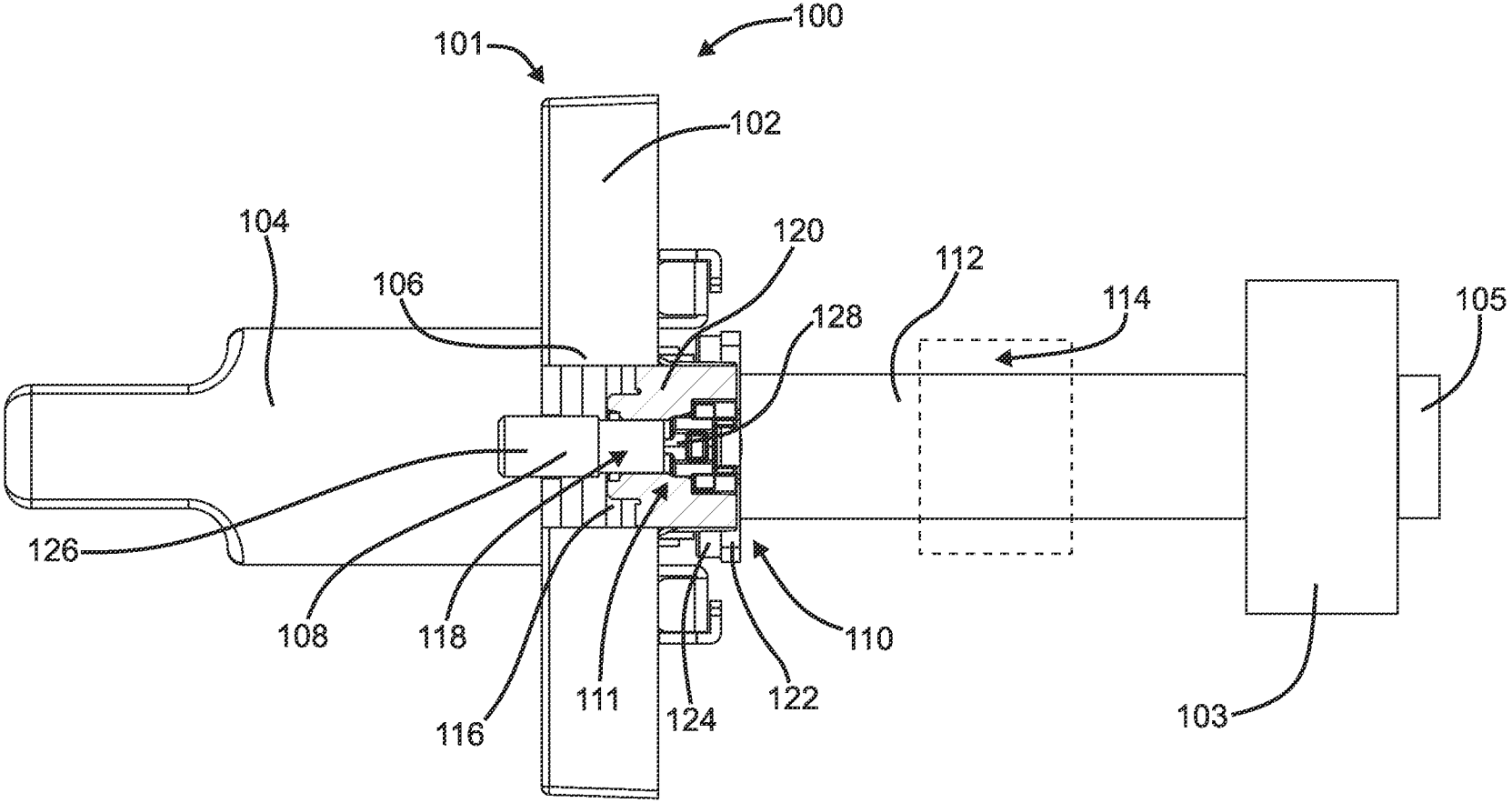
FIG. 2 illustrates a side view of a portion of the handle set of FIG. 1 with a toggle having a privacy attachment button installed.

FIG. 2 illustrates a side view of a handle set 100 with the faceplate 102 cutaway to show an interior assembly 110 of the interior portion 101. As shown, the interior handle 104 extends perpendicular from the faceplate 102, and a spindle 112 extends in the opposing direction of the interior handle 104 from the faceplate 102.

The spindle 112 is rotatable with the interior handle 104 and extends between the interior portion 101 and the exterior portion 103. The spindle 112 extends through a latch assembly 114 that is typically at least partially mounted in a bore formed in the door. When the handle set 100 is in a locked configuration, the spindle 112 is prevented from rotating, which in turn, prevents rotation of the exterior handle 105 at the exterior portion 103. In some examples, the interior handle 104 can be rotated when the handle set 100 is in the locked configuration. When the handle set 100 is in an unlocked configuration, the spindle 112 is free to rotate, thus allowing both the interior and exterior handles 104, 105 to rotate. In some examples, the interior and exterior handles 104, 105 are biased via springs to a default position.

The interior assembly 110 includes a main body 116, a toggle 118, a toggle housing 120 attached to the main body 116, a locking piece 122, and an unlocking piece 124. A locking mechanism 111 is formed of the toggle 118, the locking piece 122, and, optionally, the unlocking piece 124.

The toggle 118 includes the toggle head 108, which is shown as a privacy attachment button 126, and a toggle tail 128. The toggle 118 is positioned within the toggle aperture 106 defined at least partially by the faceplate 102 and within the toggle housing 120. In some examples, the toggle housing 120 is attached to the interior portion 101. In some examples, the toggle housing 120 is attached to the exterior portion 103, while toggle head 108 is attached, either directly or indirectly, through a bore through the door. When the handle set 100 is in the privacy mode, the toggle 118 is movable relative to the toggle housing 120 between a first position, as shown, and a second position. The first position corresponds to the unlocked configuration of the handle set 100 and the second position corresponds to the locked configuration of the handle set 100. For example, the user can access the toggle head 108 from outside of the faceplate 102 to move the toggle 118 between the first and second positions.

The toggle head 108 is separable from the toggle tail 128. Depending on which mode, either privacy or passage, the user would like the handle set 100 to have, the user attaches an appropriate toggle head 108 to the toggle tail 128. This will be described in more detail herein. In some examples, the toggle 118 is accessible from the exterior portion 103.

The locking piece 122 engages with the toggle 118, specifically with the toggle tail 128, when the toggle 118 is in the second position. The locking piece 122 prevents rotation of the exterior handle 105. In some examples, the locking piece 122 is attached to the spindle 112. When in the second position, the toggle 118 prevents rotation of the spindle 112. The locking piece 122 can be positioned either in the interior and/or exterior portions 101, 103. In the depicted example, the locking piece 122 is positioned within the interior portion, adjacent the unlocking piece 124.

The unlocking piece 124 is configured to rotate with the interior handle 104. In some examples, the handle set 100 does not include the unlocking piece 124. In some examples, the unlocking piece 124 interfaces with the toggle 118, specifically the toggle tail 128, so that upon rotation of the unlocking piece 124 via rotation of the interior handle 104, the unlocking piece 124 moves the toggle 118 from the second position to the first position. The unlocking piece 124 can be positioned in either the interior and/or exterior portions 101, 103. In the depicted example, the unlocking piece 124 is positioned within the interior portion, adjacent the locking piece 122.

Figure 3:
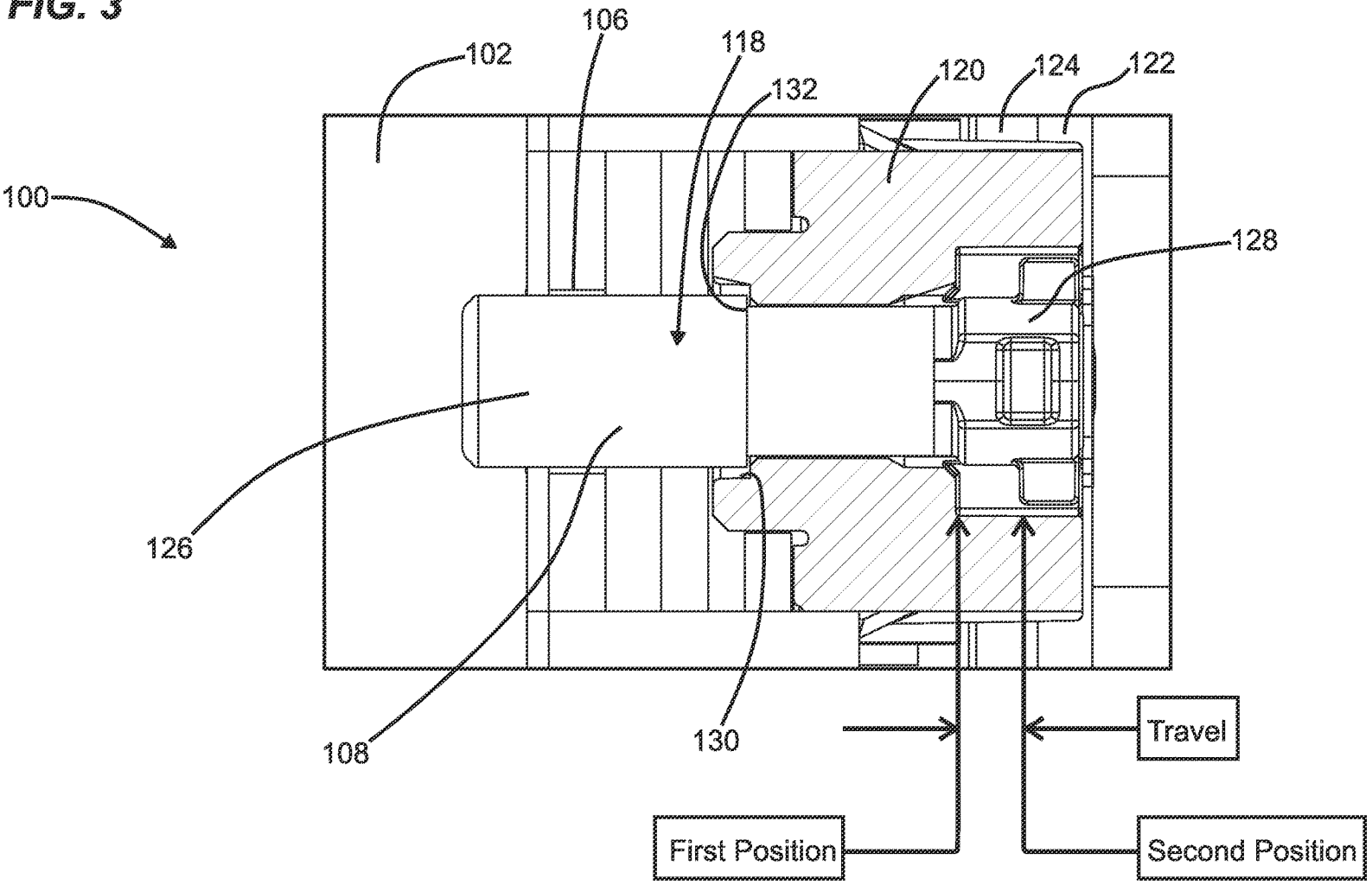
FIG. 3 illustrates a zoomed-in side view of the handle set of FIG. 1 with the privacy attachment button installed.

FIG. 3 shows a zoomed-in view of the toggle 118 within the toggle housing 120. As shown, when in the privacy mode, the toggle 118 has a range of travel between the first position and the second position. As shown, the toggle 118 is in the second position. In some examples, the toggle housing 120 defines a stop surface 130 that interfaces with a toggle head flange 132 when the toggle 118 is in the second position. Such interfacing prevents the toggle 118 from moving further past the second position. In some examples, the toggle tail 128 is configured to interface with a stop surface of the toggle housing 120 to prevent the toggle 118 from moving further past the first and/or second positions.

Figure 4:
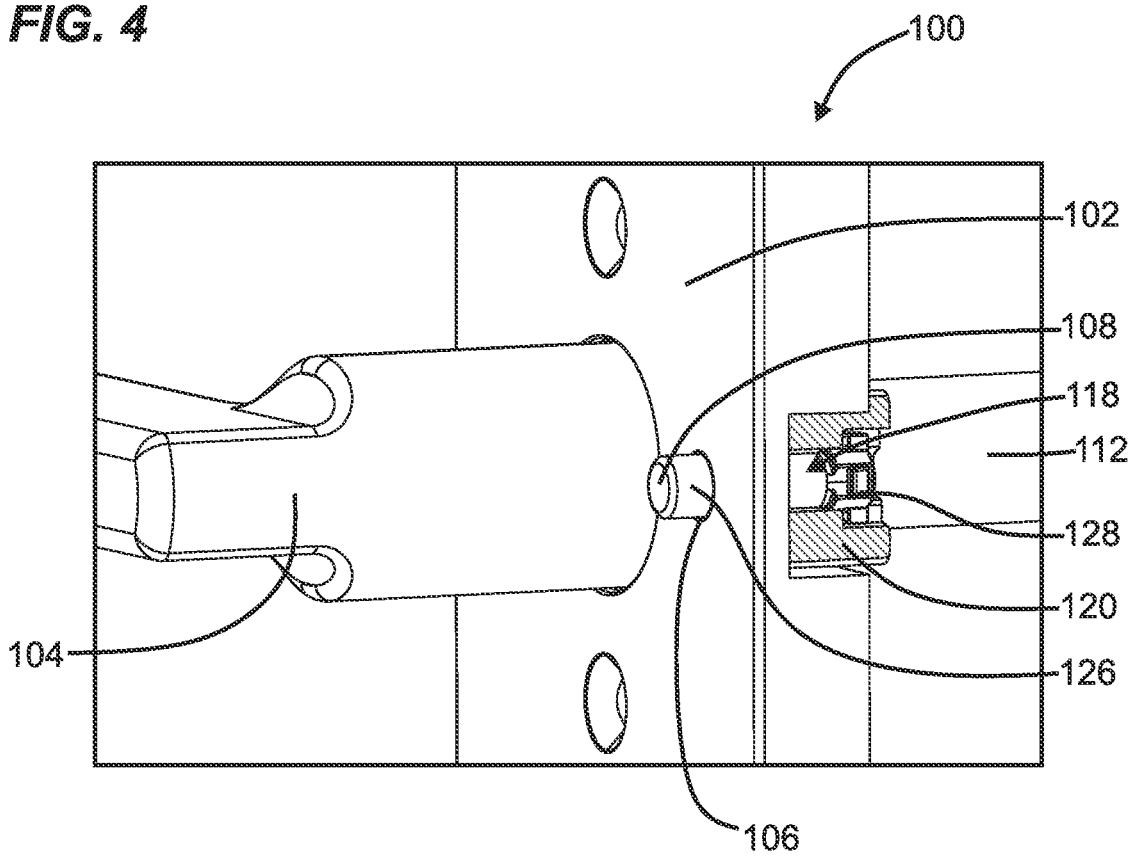
FIG. 4 illustrates a perspective view of the handle set of FIG. 1 with the privacy attachment button installed and the toggle in a first position.
Figure 5:
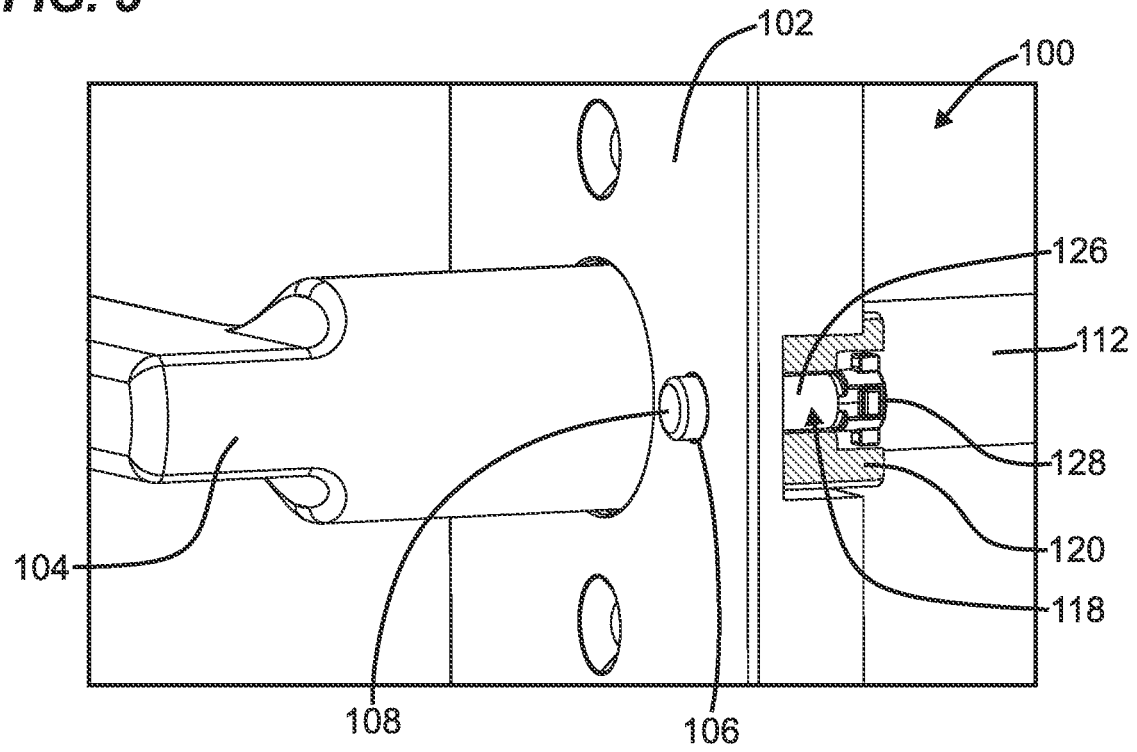
FIG. 5 illustrates a perspective view of the handle set of FIG. 1 with the privacy attachment button installed and the toggle in a second position.

FIG. 4 shows the toggle 118 in the first position, and FIG. 5 shows the toggle 118 in the second position. As shown, the privacy attachment button 126 extends further from the toggle aperture 106 when in the first position compared to the second position. In some examples, when the toggle 118 is in the second position, the privacy attachment button 126 extends from the toggle aperture 106 to allow a user to pull the privacy attachment button 126 away from the faceplate 102 to move the toggle 118 back to the first position.

Figure 6:
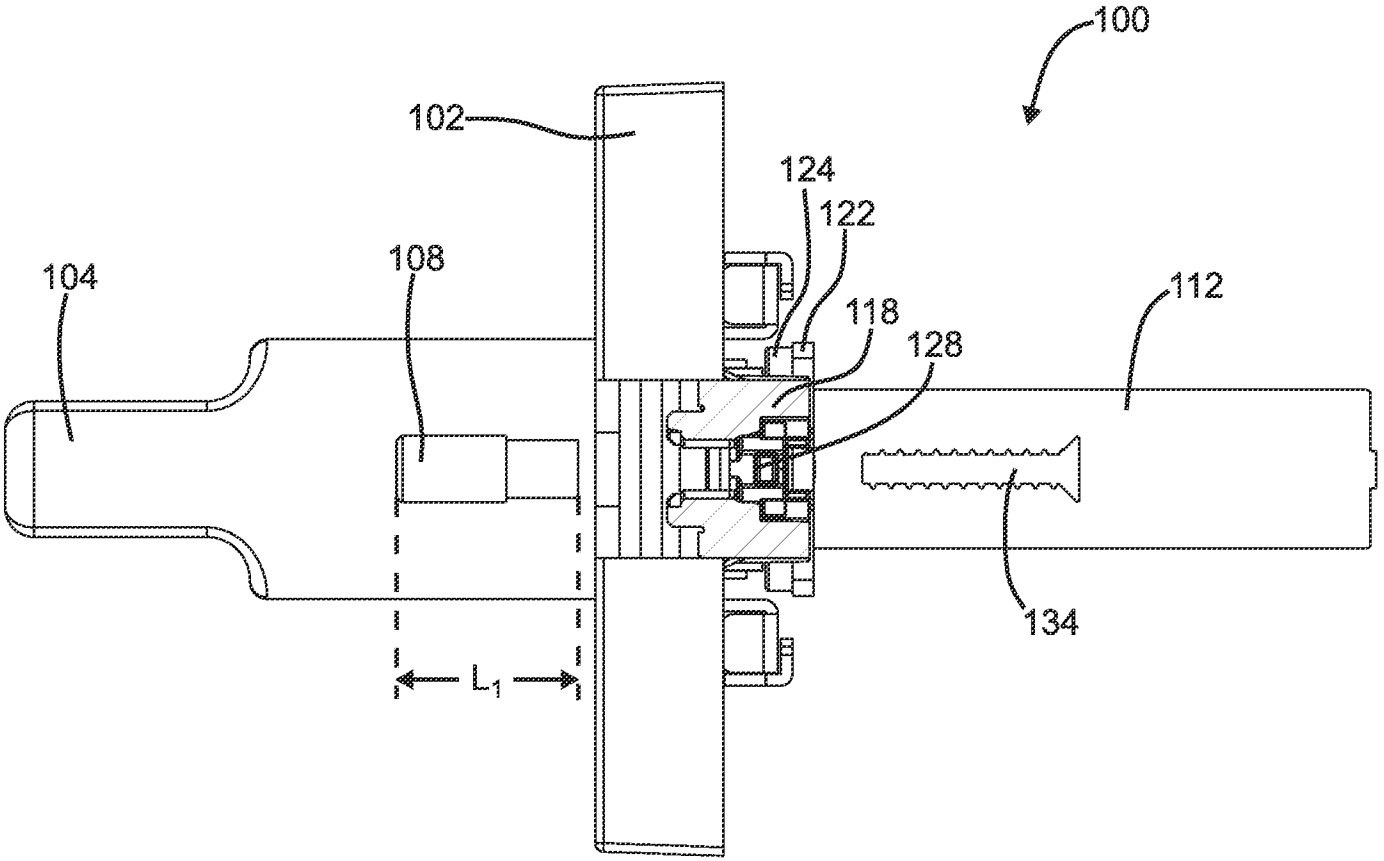
FIG. 6 illustrates a side view of the handle set of FIG. 1 with the privacy attachment button separated from a toggle tail.
Figure 7:
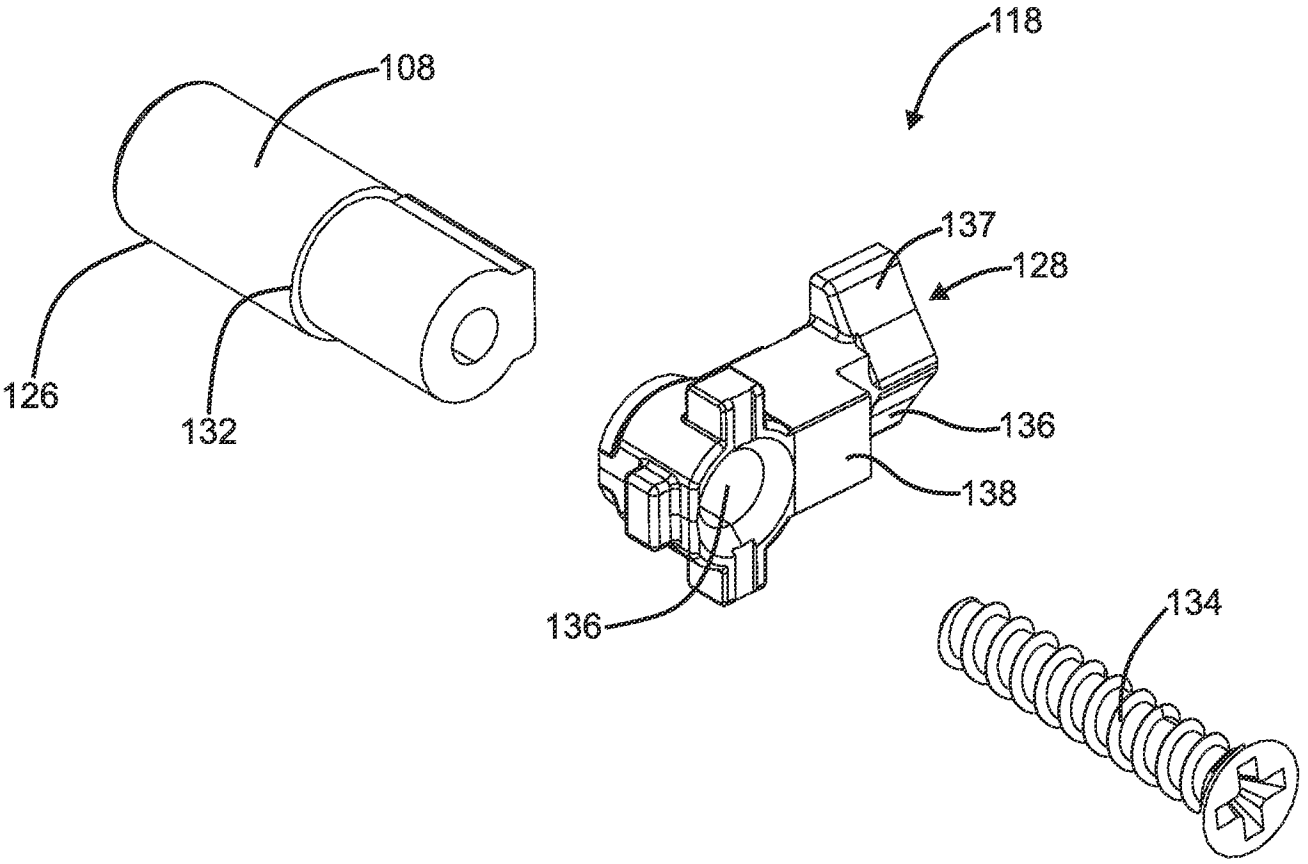
FIG. 7 illustrates a perspective view of the toggle of FIG. 1 with the privacy attachment button separated from the toggle tail.
Figure 8:
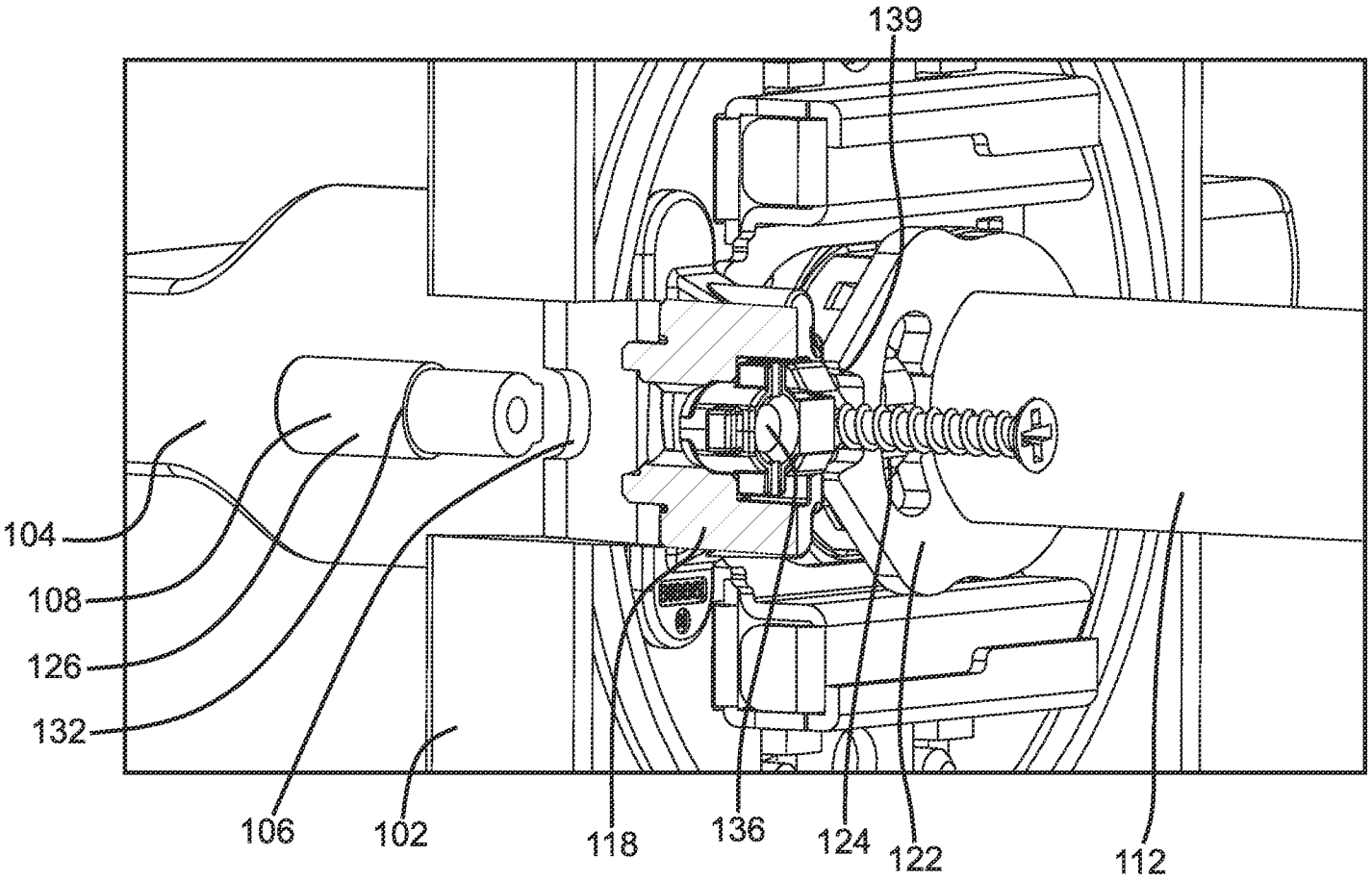
FIG. 8 illustrates a schematic perspective view of a portion of handle set of FIG. 1 with the privacy attachment button separated from the toggle tail.

FIGS. 6-8 show the toggle head 108, specifically the privacy attachment button 126, separated from the toggle tail 128. The toggle head 108 and toggle tail 128 are attachable to one another via a fastener 134. The fastener 134 can be, but is not limited to, a reusable fastener such as a screw or bolt, adhesive, or the like. In some examples, the fastener 134 is removable.

The privacy attachment button 126 has a length L1, as shown in FIG. 6. The length L1 of privacy attachment button can be a variety of different lengths. In some examples, the length L1 allows for the privacy attachment button 126 to extend out of the toggle aperture 106 when in either the first or second positions when the privacy attachment button 126 is attached to the toggle tail 128.

FIG. 7 shows the disassembled toggle 118. The fastener 134 is inserted through a fastener aperture 136. The toggle tail 128 includes a ramped portion 137, a locking flange 138, and the fastener aperture 136. The ramped portion 137 is configured to interface with the unlocking piece 124 to move the toggle 118 from the second position to the first position.

As shown in FIG. 8, the locking flange 138 of the toggle tail 128 is configured to be selectively positioned in a locking notch 139 of the locking piece 122 when the toggle 118 is in the second position. To assemble the toggle 118, the toggle tail 128 is positioned within the toggle housing 120. The fastener 134 is then passed through the fastener aperture 136 and attached to the toggle head 108 while the toggle head 108 is positioned within the toggle aperture 106. Such assembly can be done during installation of the handle set 100.

Figure 9:
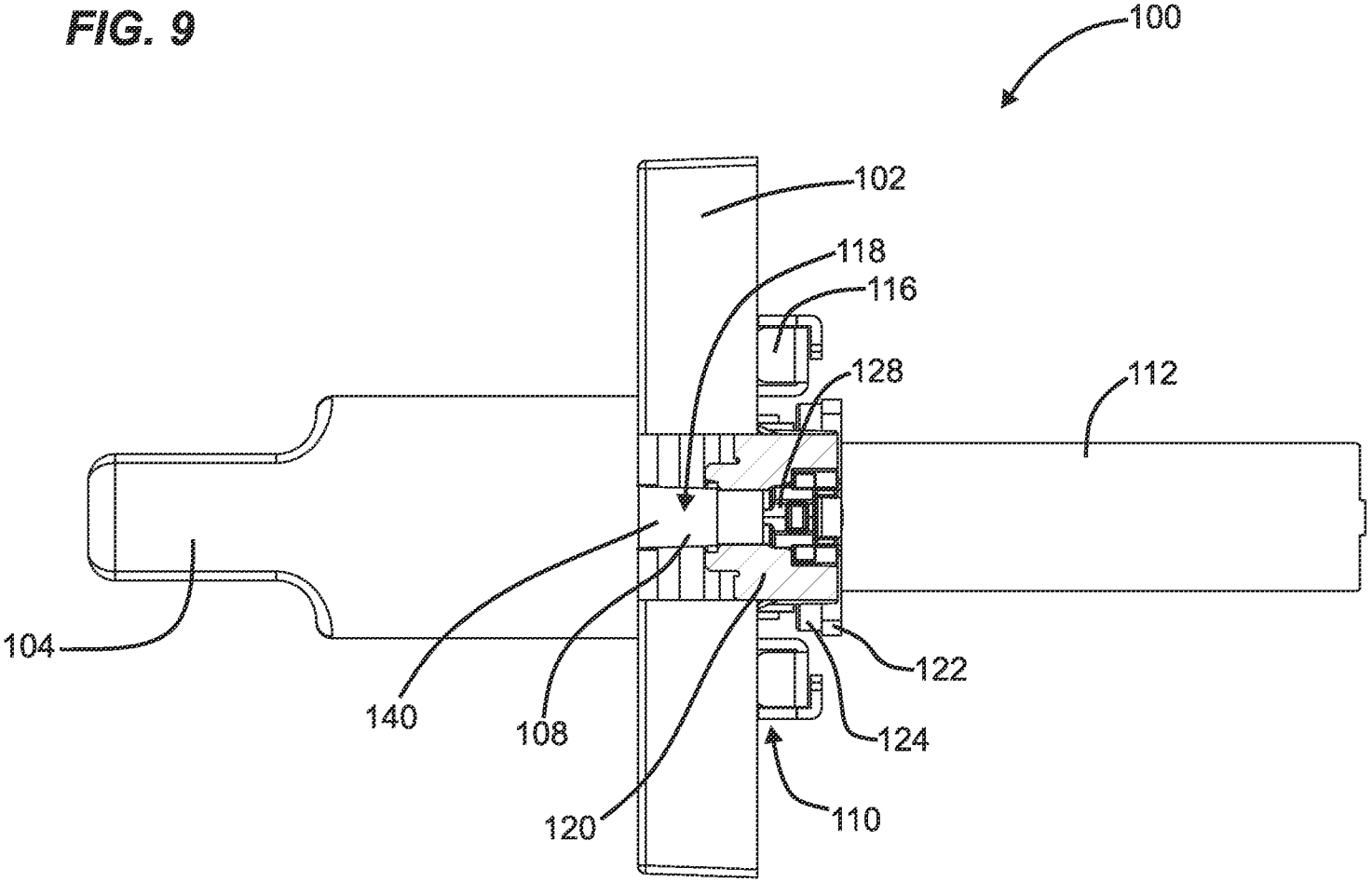
FIG. 9 illustrates a side view of the handle set of FIG. 1 with a toggle having a passage attachment button installed.

FIG. 9 illustrates a side view of the handle set 100 with a passage function and not a privacy function. The toggle head 108 is a passage attachment button 140 attached to the toggle tail 128.

Figure 10:
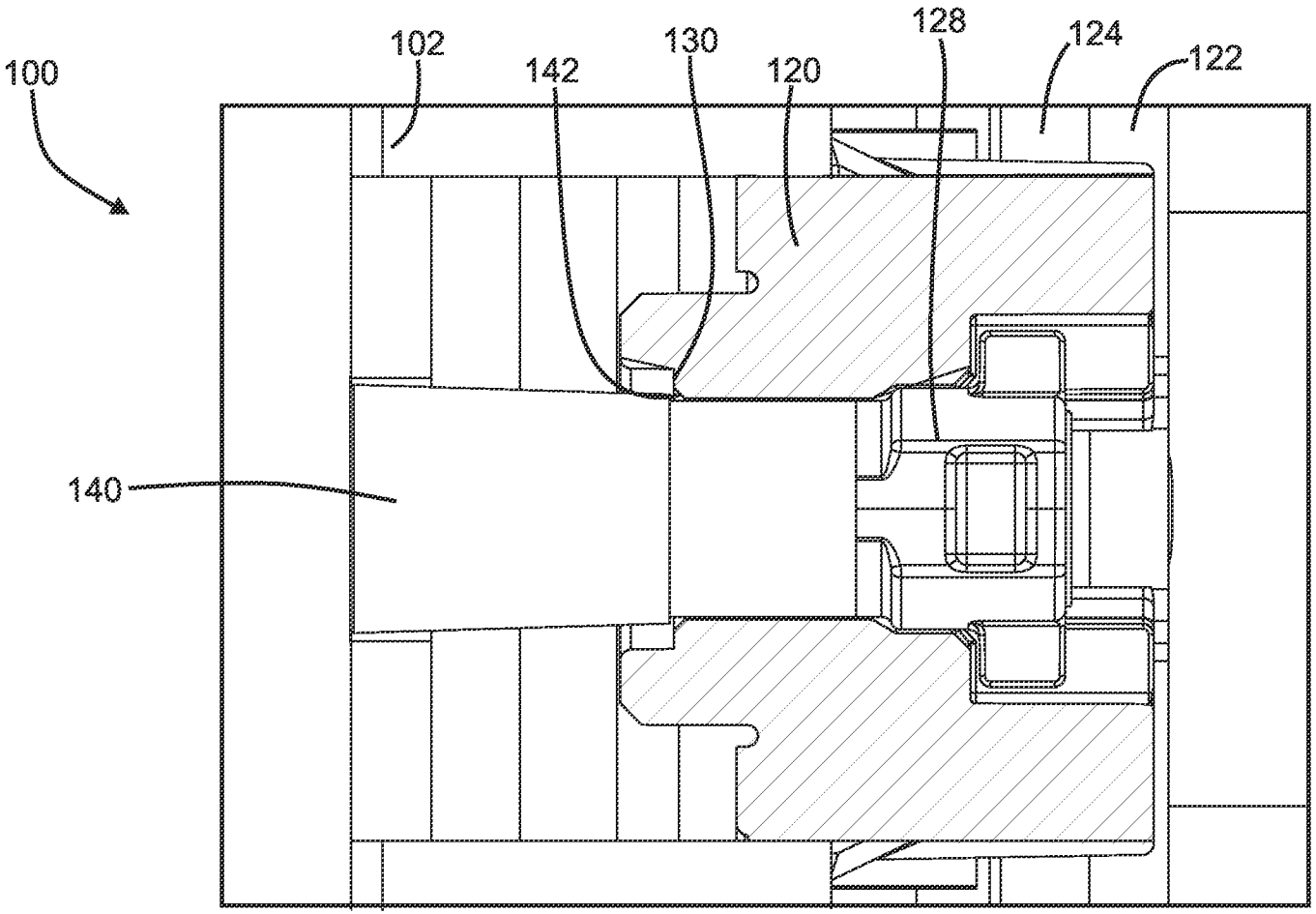
FIG. 10 illustrates a zoomed-in side view of the handle set of FIG. 1 with the passage attachment button installed.

FIG. 10 shows a zoomed-in view of the toggle 118 within the toggle housing 120 with the passage attachment button 140 attached to the toggle tail 128. As shown, when in the passage mode, the toggle 118 cannot be moved from the first position. In some examples, the toggle 118 is prevented from axially moving with respect to the toggle housing 120. Such a lack of movement prevents the handle set 100 from being locked because the toggle 118 cannot be moved into the second position.

In some examples, the stop surface 130 of the toggle housing 120 interfaces with a toggle head flange 142 of the passage attachment button 140 when the passage attachment button 140 is attached to the toggle tail 128. Such interfacing prevents the toggle 118 from moving further past the first position. In some examples, the toggle tail 128 is configured to interface with a stop surface of the toggle housing 120 to prevent the toggle 118 from moving from the first position. In such example embodiments, a distance from the toggle head flange 142 to an insertion end of the passage attachment button 140 is smaller than a distance from the toggle head flange 132 to an insertion end of the privacy attachment button 126, thereby preventing the passage attachment button from extending into the toggle aperture 106 sufficiently to move the toggle 118.

Figure 11:
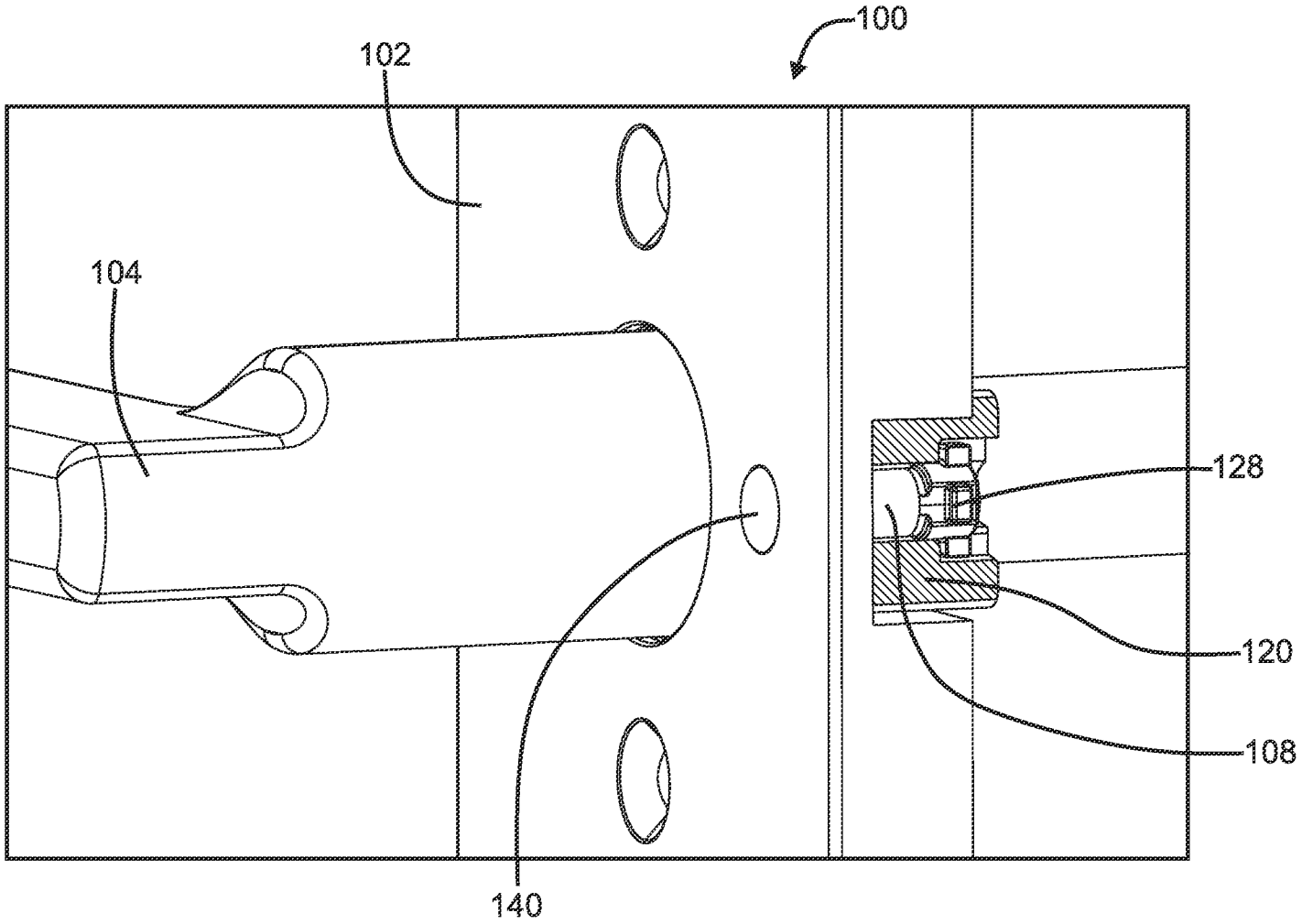
FIG. 11 illustrates a perspective view of the handle set of FIG. 1 with the passage attachment button installed and the toggle in a first position.

Specifically, FIG. 11 shows the toggle 118 in the first position. In the depicted example, the passage attachment button 140 is substantially flush with the faceplate 102. In some examples, the passage attachment button 140 extends from the toggle aperture 106 but does not allow a user to move the toggle 118.

Figure 12:
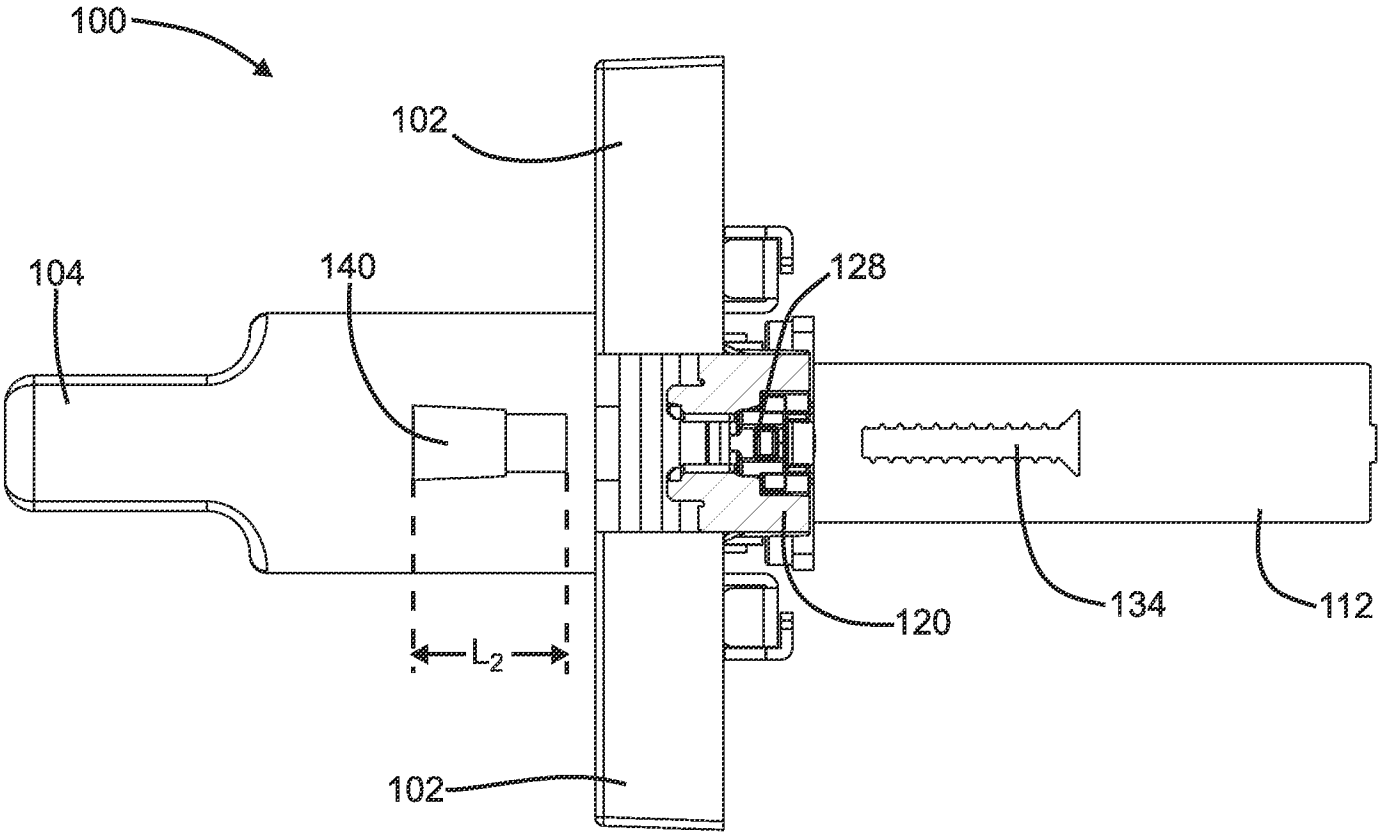
FIG. 12 illustrates a side view of the handle set of FIG. 1 with the passage attachment button separated from the toggle tail.
Figure 13:
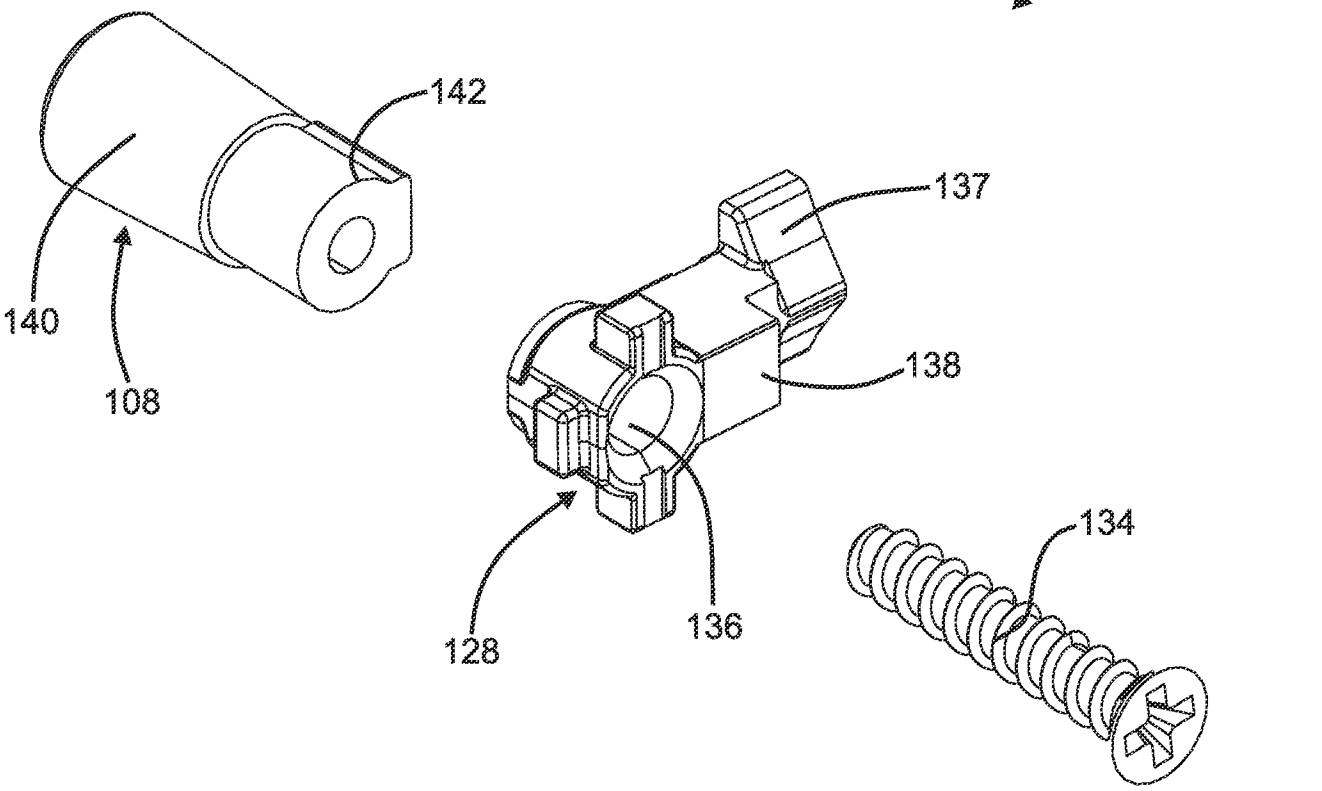
FIG. 13 illustrates a perspective view of the toggle of FIG. 1 with the passage attachment button separated from the toggle tail.
Figure 14:
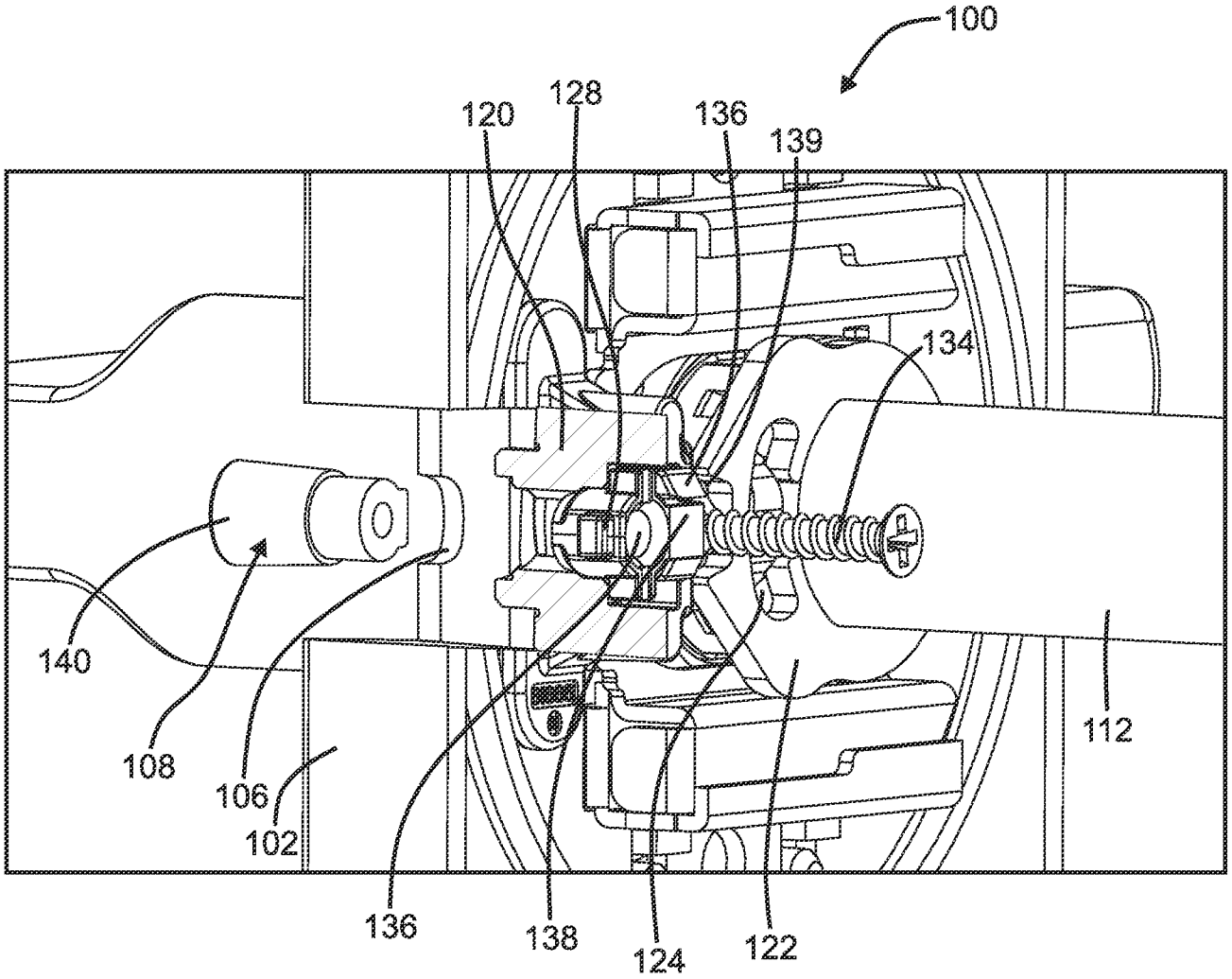
FIG. 14 illustrates a schematic perspective view of the portion handle set of FIG. 1 with the passage attachment button separated from the toggle tail.

FIGS. 12-14 show the toggle head 108, specifically the passage attachment button 140, separated from the toggle tail 128. Like the privacy attachment button 126 described above, the passage attachment button 140 and toggle tail 128 are attachable to one another via a fastener 134.

The passage attachment button 140 has a length L2, as shown in FIG. 12. The length L2 of passage attachment button can be a variety of different lengths. In some examples, the length L2 allows for the passage attachment button 140 to be positioned substantially flush to the faceplate 102, and not extend out of the toggle aperture 106 when attached to the toggle tail 128. In some examples, the length L2 of the passage attachment button 140 is less than the length L1 of the privacy attachment button 126. This difference in length can be, for example, based on a difference in length from the toggle head flange 142 to the insertion end of the passage attachment button 140 as compared to a distance from the toggle head flange 132 to the insertion end of the privacy attachment button 126, as noted above.

In some examples, the handle set 100 can be provided with both the privacy attachment button 126 and the passage attachment button 140. When installing, the user can choose to install the privacy attachment button 126 or the passage attachment button 140 to the toggle tail 128 to have a door that either has a privacy mode or passage mode. Such an example allows for a single handle set 100 to be distributed that can either have a privacy or passage mode instead of offering one handle set with a privacy function and one handle set with a passage mode, resulting in multiple stock keeping units (SKU).

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A handle set comprising:

a main body having a handle and a faceplate positioned around the handle, the faceplate having a toggle aperture; and a locking mechanism including:

a locking piece having a locking notch; and a toggle positioned within a toggle housing attached to the main body, the toggle being movable relative to the toggle housing, the toggle including:

a toggle tail configured to be received into the locking notch; and a toggle head removably attached to the toggle tail, the toggle head being at least one of:

a privacy attachment button, wherein at least a portion of the privacy attachment button extends from the toggle aperture and beyond the faceplate, wherein push and pull loads applied to the privacy attachment button result in translation of the toggle with respect to the toggle housing; or a passage attachment button, wherein the passage attachment button interfaces with the toggle housing to prevent relative movement between the passage attachment button and the toggle housing, wherein the privacy attachment button is longer than the passage attachment button.

2. The handle set of claim 1, further comprising an exterior portion having an exterior handle, wherein a portion of the toggle tail is accessible through an opening in the exterior portion.

3. The handle set of claim 1, wherein the passage attachment button is positioned flush with the faceplate.

4. The handle set of claim 1, wherein the passage attachment button interfaces within a flange of the toggle housing to prevent relative movement between the toggle and the toggle housing.

5. The handle set of claim 1, wherein the privacy attachment button has a length between a toggle head flange and an inserted end that is greater than a length between the toggle head flange and an inserted end of the passage attachment button.

6. The handle set of claim 1, further comprising an unlocking piece connected to main body, wherein, when the handle is actuated, the unlocking piece will rotate and move the toggle tail out of engagement with the locking piece.

7. The handle set of claim 6, wherein the toggle tail includes a ramped segment to engage the unlocking piece, wherein when engaged with the toggle tail, the unlocking piece moves the toggle relative to the toggle housing.

8. The handle set of claim 1, wherein the toggle tail includes a ramped portion and a locking flange, wherein the ramped portion extends past the locking flange and wherein the locking flange is selectively received within the locking notch of the locking piece to block rotation of the locking piece.

9. The handle set of claim 8, further comprising an unlocking piece connected to the main body, wherein, when the handle is actuated, the unlocking piece will rotate and translate the toggle tail out of the locking piece, and wherein the ramped portion of the toggle tail engages with the unlocking piece to move the toggle with respect to the toggle housing in response to rotation of the unlocking piece.

10. The handle set of claim 1, further comprising a spindle rotatable within the handle, wherein the locking piece rotates with the spindle.

11. The handle set of claim 1, wherein the toggle head is connected to the toggle tail via a reusable fastener.

12. The handle set of claim 11, wherein the reusable fastener is a screw.

13. The handle set of claim 1, wherein when the toggle head is the privacy attachment button, the handle set has a locked configuration and an unlocked configuration, and wherein, when in the locked configuration, a portion of the toggle tail is positioned within the locking notch.

14. A handle set comprising:

an exterior portion having an exterior handle;

an interior portion having an interior handle, the interior portion having an interior faceplate positioned around the interior handle and the interior faceplate having a toggle aperture;

a spindle extending between the exterior and interior portions to translate a door latch;

wherein, the exterior and interior portions each comprise:

exterior and interior assembly portions configured to operatively connect the spindle to the exterior and interior handles, respectively; and a locking mechanism including:

a locking piece having a locking notch operatively connected to at least one of the exterior or interior portions; and a toggle positioned within a toggle housing connected to at least one of the exterior or interior portions; the toggle being movable relative to the toggle housing, the toggle including:

a toggle tail configured to be received into the locking notch; and a toggle head removably attached to the toggle tail, the toggle head being at least one of:

a privacy attachment button, wherein at least a portion of the privacy attachment button extends from the toggle aperture and beyond the interior faceplate, wherein push and pull loads applied to the privacy attachment button result in translation of the toggle with respect to the toggle housing; or a passage attachment button, wherein the passage attachment button is positioned within the toggle aperture and flush with the interior faceplate, and wherein the passage attachment button interfaces with the toggle housing to prevent relative movement between the passage attachment button and the toggle housing; and an unlocking piece connected to at least one of the exterior or interior portions and configured to receive the spindle therein, wherein, when the interior handle is actuated, the spindle will rotate the unlocking piece to translate the toggle tail out of engagement with the locking piece, wherein the privacy attachment button is longer than the passage attachment button.

15. The handle set of claim 14, wherein the passage attachment button interfaces within a flange of the toggle housing to prevent relative movement between the toggle and the toggle housing.

16. The handle set of claim 14, wherein the toggle tail includes a ramped portion and a locking flange, wherein the ramped portion extends past the locking flange and wherein the locking flange is selectively received within the locking notch of the locking piece to block rotation of the locking piece, wherein, when the interior handle is actuated, the unlocking piece will rotate and translate the toggle tail out of the locking piece, and wherein the ramped portion of the toggle tail engages with the unlocking piece to move the toggle with respect to the toggle housing in response to rotation of the unlocking piece.

17. The handle set of claim 14, wherein the toggle head is connected to the toggle tail via a reusable fastener.

18. The handle set of claim 14, wherein when toggle head is the privacy attachment button, the handle set has a locked configuration and an unlocked configuration, and wherein, when in the locked configuration, a portion of the toggle tail is positioned within the locking notch.

19. A method of selecting a privacy or passage mode for a handle set, the method comprising:

providing a handle set including:

a locking mechanism including:

a locking piece having a locking notch; and a toggle positioned within a toggle housing, the toggle being movable relative to the toggle housing, the toggle including:

a toggle tail configured to be received into the locking notch; and a toggle head removably attached to the toggle tail, the toggle head being at least one of:

a privacy attachment button, wherein push and pull loads applied to the privacy attachment button result in translation of the toggle with respect to the toggle housing; or a passage attachment button, wherein the passage attachment button interfaces with the toggle housing to prevent relative movement between the passage attachment button and the toggle housing;

attaching at least one of the privacy attachment button and the passage attachment button to the toggle tail;

activating a privacy mode when the privacy attachment button is attached to the toggle tail, wherein, when in the privacy mode, the handle set has a locked configuration and an unlocked configuration, wherein, in the locked configuration, the toggle tail is positioned within the locking notch; and activating a passage mode when the passage attachment button is attached to the toggle tail, wherein, when in the privacy mode, the handle set only has an unlocked configuration, wherein the privacy attachment button is longer than the passage attachment button.

* * * * *